US007306472B2

(12) United States Patent
Matsumoto et al.

(10) Patent No.: US 7,306,472 B2
(45) Date of Patent: Dec. 11, 2007

(54) CONNECTOR

(75) Inventors: Hiroyuki Matsumoto, Kanagawa (JP); Satoshi Kaneko, Saitama (JP); Masayoshi Kokusho, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/603,071

(22) Filed: Nov. 22, 2006

(65) Prior Publication Data

US 2007/0123080 A1 May 31, 2007

(30) Foreign Application Priority Data

Nov. 25, 2005 (JP) ..... 2005-341130

(51) Int. Cl.
*H01R 13/213* (2006.01)
*H01R 13/62* (2006.01)

(52) U.S. Cl. ..... 439/314; 439/354

(58) Field of Classification Search ..... 439/314, 439/319, 318, 312, 313, 354, 357, 358
See application file for complete search history.

(56) References Cited

FOREIGN PATENT DOCUMENTS

JP 06-302356 10/1994

*Primary Examiner*—Javaid H. Nasri
(74) *Attorney, Agent, or Firm*—Squire, Sanders & Dempsey L.L.P.

(57) ABSTRACT

To provide a connector in which a plug and a receptacle can be connected easily and the plug and the receptacle are separated from each other by rotating a coupling ring. A plug (1) is structured so that an inner circumference of an external cylinder (11) includes a pair of the projections (11*a*) and (11*b*). A receptacle (2) is structured so that the projections (11*a*) and (11*b*) are inserted in the axial direction to a pair of first elastic pieces (2*a*) to provide an engagement therebetween. The engagement between the projection (11*a*) and the first elastic pieces (2*a*) provides a connection between the plug (1) and the receptacle (2). The receptacle (2) includes a rail groove (2*a*) in which, when the external cylinder (11) is rotated, the projection (11*a*) moves the plug 1 in a direction along which the plug (1) is away from the receptacle (2).

18 Claims, 8 Drawing Sheets

CONNECTOR

This application is based on and claims the benefit of priority from Japanese Patent Application No. 2005-341130, filed on 25 Nov. 2005, the content of which is incorporated herein by reference.

BACKGROUND OF THE INVENTION

1. Field of the Invention

The present invention relates to a connector for electrical connection. In particular, the present invention relates to a round connector that basically has a cylindrical shape and that has a circular engagement section. For example, the round connector is structured so that first connecting device is composed of a receptacle and the second connecting device is composed of a plug.

2. Related Art

One of known round connectors is, for example, a connector having a rotation guide in which an external cylinder (so-called coupling ring) is turned to guide an engagement operation. A receptacle is structured so that an outer circumference face at an end includes a male thread and a rotation ring that includes a female thread engageable with this male thread is attached to an outer circumference of a plug. When the rotation ring is rotated while the receptacle is being opposed to the plug, the male thread is engaged with the female thread to allow the receptacle to be in the vicinity of the plug, thereby providing electrical and mechanical connections between the receptacle and the plug. When the rotation ring is rotated in an opposite direction, the receptacle is away from the plug connector, thereby cancelling the electrical and mechanical connections.

The above-described connector having a rotation guide providing connection by a screw is structured to provide the connection and separation by rotating the rotation ring. However, this connector has a problem in that an insufficient connection may be caused because only the rotation of the rotation ring cannot sufficiently tell a user the connection status. Japanese Unexamined Patent Application Publication No. 6-302356 (hereinafter referred to as Patent Document 1) discloses a connector having a rotation guide by which an electrical connection status may be clearly shown and an insufficient connection status is suppressed from being caused.

The connector having a rotation guide according to Patent Document 1 is designed so that an external cylinder is turned to provide an engagement between a positioning projection and a guide groove to cause a charger-side plug to be adjacent to a storage battery-receptacle while the external cylinder and the inner cylinder being locked with a predetermined positional relation by a plurality of grooves and a plunger mechanism. According to Patent Document 1, this positional relation provides the locking position corresponding to a connection status between power source terminals and signal terminals in the plug and the receptacle, thus showing the connection status of the terminal by the rotation status seen from the exterior.

FIG. 12 is an external perspective view illustrating a charger-side plug using the connector having a rotation guide according to Patent Document 1. FIG. 12 of this application corresponds to FIG. 1 of Patent Document 1. FIG. 13 is an external perspective view illustrating a capacitor-side receptacle according to Patent Document 1. FIG. 13 of this application corresponds to FIG. 2 of Patent Document 1.

In FIG. 12, the charger-side plug 80 is structured so that an outer circumference of a columnar inner cylinder 81 is attached with an external cylinder 82 having a cylindrical shape such that the external cylinder 82 is rotatable and cannot be moved in the longitudinal direction. The inner cylinder 81 is structured so that one end-side opening includes power source terminals 81*a* and 81*b* for supplying power for charging and signal terminals 82*a*and 82*b* for transmitting charging-related information. The plug 80 is provided so that the power source terminals 81*a* and 81*b* are slightly longer than the signal terminals 82*a* and 82*b*. The other end of the inner cylinder 81 includes therein an electric wire extending while being connected to the power source terminals 81*a* and 81*b* and the signal terminals 82*a* and 82*b*.

A rear end of the inner cylinder 81 at which the electric wire extends constitutes a grip section 83. The outer circumference of the inner cylinder 81 including the grip section 83 includes three circular grooves 84*a* to 84*c* arranged in the axis line direction. The external cylinder 82 is provided at the periphery of the front end of the inner cylinder 81. The inner circumference face of this front end-side includes a helical guide groove 821 in which one end is opened at the front end of the external cylinder 82. The guide groove 821 is formed within a range of substantially 90 degrees and this pitch of 90 degrees is a length required for the mutual disconnection of the connectors.

The rear end of the external cylinder 82 includes a finger section 823 extruding outward. The finger section 823 includes therein a plunger mechanism 822. The plunger mechanism 822 is composed of: a tube section that is provided in the finger section 823 in the diameter direction and that communicates with the inner circumference face; a ball stored in the tube section; and a compression coil spring that is provided in the tube section to bias the ball to the inner circumference face (hereinafter referred to as spring). The ball has a diameter that is slightly smaller than the inner diameter of the tube section and that allows the ball to be locked with the grooves 84*a* to 84*c*.

At the middle of the external cylinder 82, a groove-like spring rail groove (not shown) is provided at the semicircle part of the lower surface. The spring rail groove stores therein the spring. One end of the spring is fixed to one end of the spring rail groove via a screw and the other end of the spring is fixed to the lowest surface of the inner cylinder 81 via a screw. On the other hand, the inner cylinder 81-side includes a rotation-regulating groove (not shown) formed for a range of about 90 degrees and the external cylinder 82 correspondingly includes a rotation-suppressing pin 826 having a tip end inserted into the rotation-regulating groove. The rotation-suppressing pin 826 can be rotated in the rotation-regulating groove in a range within which the spring expands and contracts in the spring rail groove in a range of 90 degrees.

In FIG. 13, a storage battery-side receptacle 90 is composed of: a flat plate-like saddle 91; and a terminal section 92 protruding from the saddle 91. The opening of the terminal section 92 includes power source terminals 91*a* and 91*b* and signal terminals 92*a* and 92*b* at positions opposed to the power source terminals 81*a* and 81*b* and the signal terminals 82*a* and 82*b* (see FIG. 9). The receptacle 90 is provided so that the power source terminals 91*a* and 91*b* are slightly longer than the signal terminals 92*a* and 92*b*.

At the peripheral edge of the terminal section 92, a cylindrical hood section 93 is formed. The hood section 93 surrounds the power source terminals 91*a* and 91*b* and the signal terminals 92*a* and 92*b* and protrudes so as to be opposed to the inner cylinder 910. At the upper side of the hood section 93, a positioning projection 921 is formed that can be inserted into the guide groove 821. The upper side of the saddle 91 is attached with a watertight cap 95 that is provided in a rotatable manner and that covers the opening of the hood section 93.

The connector having a rotation guide according to Patent Document 1 is structured so that the plug and the receptacle are attached to each other and detached from each other by rotating the coupling ring in forward and reverse directions. The plug and the receptacle can be in adjacent to each other in the axial direction to be engaged (or connected) to provide an easy and convenient connection quicker than the conventional rotation operation. For example, this structure also may be considered as the one in which whether the plug is correctly connected to the receptacle or not is confirmed by a click feeling during the engagement.

On the other hand, a structure in which the rotation of the coupling ring is followed by an operation for moving the plug and the receptacle so that they are away from each other also can secure, after the mutual signal terminals are disengaged and before the mutual power source terminals are disengaged, a time required for turning OFF the power source. This structure prevents, when the mutual power source terminals are disengaged, spark from being caused, thus preventing the power source terminal from deteriorating. Due to the situation as described above, such a connector having a rotation guide has been desired in which a plug and a receptacle are adjacent to each other in the axial direction and are connected to each other and a coupling ring is rotated to move the plug and the receptacle away from each other. It is an objective of the present invention to provide such a connector having a rotation guide.

SUMMARY OF THE INVENTION

In view of the problem as described above, it is an objective of the present invention to provide a connector having a rotation guide in which a plug and a receptacle can be moved closer to each other in the axial direction and in which the plug and the receptacle are separated from each other by rotating a coupling ring.

In order to satisfy the above objective, the inventor provides connection of two connectors by a structure in which first connecting device includes a projection at an inner circumference of the coupling ring and the second connecting device includes a lance to which the projection is inserted in the axial direction to provide an engagement therebetween. The second connecting device includes a rail groove in which, when the coupling ring is rotated, the projection moves the one plug in a direction along which the plug is away from the receptacle. Thus, the inventor has achieved a connector having a rotation guide as described below.

The first aspect of the present invention provides: a connector in which a first connecting device and a second connecting device are attachable and detachable with respect to each other, wherein, the first connecting device comprises: an external cylindrical cylinder, a first substantially columnar housing rotatably retained in an inner circumference of the external cylinder, and a first terminal group which is retained in the first housing and that is stored in an opening at one end of the external cylinder; the second connecting device comprises: a second housing having a substantially cylindrical connection end that can be inserted into the opening at one end of the external cylinder, and a second terminal group that is stored in the connection end and connected to the first terminal group; wherein the external cylinder includes: one or more projections protruding from an inner wall of one end of the external cylinder, an outer circumference of the connection end, including rail grooves for guiding the projections, the rail grooves including a first straight rail groove extending in parallel with the axial direction from one end of the connection end to the other end, and a first lancet-shaped elastic piece provided at an end point of the first straight rail groove in order to lock the projection, wherein when the first connecting device is inserted into the second connecting device, the projection is locked to the first elastic piece to connect the first connecting device and the second connecting device and, when the first connecting device is rotated and withdrawn from the second connecting device, the first connecting device and the second connecting device are disengaged from each other.

According to the first aspect of the present invention, the first connecting device includes an external cylindrical cylinder and a first substantially columnar housing and a first terminal group. The first housing is rotatably retained in an inner circumference of the external cylinder. The first terminal group is retained in the first housing and is stored in an opening at one end of the external cylinder. The second connecting device includes a second housing and a second terminal group. The second housing has a substantially cylindrical connection end that can be inserted into an opening at one end of the external cylinder. The second terminal group is stored in the connection end. The second terminal group is connected with the first terminal group. Thus, the first connecting device and the second connecting device can be mutually attached and detached.

The first connecting device may be a plug while the second connecting device may be a receptacle. The plug is generally a movable part and is attached to a cable or a detachable subassembly. On the other hand, the receptacle is generally a fixed side attached to a panel, a board, or a frame for example. The receptacle as described above is also called as a panel attachment-type connector.

A multipolar plug is generally inserted with a female contact. For example, a female contact is defined as a contact that receives a male contact and the inner surface thereof provides an electrical connection. A female contact is classified to a socket contact joined with a pin contact and a receptacle contact joined with a tab contact for example. On the other hand, a multipolar receptacle is generally inserted with a male contact. For example, a male contact is defined as a contact that is inserted into a female contact so that the outer surface thereof provides an electrical connection. A male contact is classified to a pin contact, a post contact, and a tab contact.

However, a connector inserted with a female contact cannot function as a plug and a connector inserted with a male contact cannot function as a receptacle. For example, a plug also may be inserted with a male contact and a receptacle also may be inserted with a female contact. As described later, the first and second terminal groups include a plurality of power source terminals (contacts) and signal terminals (contacts). These power source terminals and signal terminals may be structured so that one side functions as a female contact while the other side functions as a male contact and also may be a plate-like contact in which a male-side or a female-side cannot be identified. Thus, the connection between the plug and the receptacle is established. Here, the term "connection" may represent mechanical and electrical connections.

The first connecting device may be a round multipolar connector connected with an electric wire for example and includes a first substantially columnar housing. The second connecting device may be a round multipolar connector attached to a panel (including a chassis) for example and has a substantially cylindrical connection end. Here, the first and second housings may have an insulation property and may be made of nonconductive material. For example, an insulating housing can be obtained by molding synthetic resin material to have a desired shape. The first housing and the second housing may be made of the same insulating material or also may be made of different insulating materials.

For example, the external cylinder may be made of conductive metal or also may be made of nonconductive insulating material. For example, a cylindrical external cylinder can be obtained by molding synthetic resin material. In order to provide the first connecting device with a light weight, the external cylinder may be made of aluminum having a small specific gravity and the external cylinder may be made of the same synthetic resin material as that of the first housing. However, the material of the external cylinder is not limited to the same insulating material as that of the first housing.

The first housing rotatably retained in the inner circumference of the external cylinder includes an aspect in which the first housing is immovably retained in the inner circumference of the external cylinder in the axial direction. For example, the first housing also may be set in the external cylinder by the so-called permanent setting. The term "rotation" or "turning" means an operation for causing a circular motion by a predetermined angle in forward and reverse directions. When the first housing is assumed as a fixed side and the external cylinder is assumed as a rotating side, the external cylinder is rotated from a position at which the first housing is engaged with the second housing to a position at which the engagement is cancelled. For example, in order to prevent the external cylinder from being rotated to the first housing by an angle that is equal to or higher than a required angle, the outer circumference of the first housing and the inner circumference of the external cylinder may alternatively include steps so that the rotation angle of the external cylinder can be regulated. The external cylindrical cylinder used for the insertion and withdrawal of a connector is called as a coupling ring.

For example, one end of the external cylinder has a circular opening and the first terminal group is stored in a columnar opening having this circular opening. Here, the wording "the first terminal group is stored" includes an arrangement in which the first terminal group is included in the first housing by an insertion, retention, or storage for example and one end of the first terminal group (i.e., a part connected with the second terminal group) is provided in a space in the external cylinder.

The second housing is preferably provided so that the outer diameter of the connection end is slightly smaller than the inner diameter of the external cylinder and the connection end is engaged with the external cylinder in a detachable manner for example. The connection end has a predetermined length inserted into one end of the external cylinder. The connection end having a substantially cylindrical shape includes a shape in which the outer circumference of the connection end includes a rail groove (which will be described later) and the outer circumference of the connection end other than the rail groove is slid with the inner circumference of the external cylinder. For example, one end of the connection end has an opening and the connection end stores therein a part of the second terminal group in a protruding manner. For example, the other end of the connection end also may include a flat plate-like saddle so that the connection end can be fixed to a panel.

The connector according to the first aspect of the present invention as described above is structured so that the external cylinder has one or more projections protruding from an inner wall of one end of the external cylinder. The outer circumference of the connection end includes a rail groove for guiding the projection. The rail groove includes the first straight rail groove extending in parallel with the axial direction from one end of the connection end to the other end.

For example, the projection may be provided at the inner wall of one end of the external cylinder to protrude to have a columnar shape or may protrude from the inner wall of one end of the external cylinder to have a square pole-like shape. The projection protrudes to the axial center of the external cylinder. One projection may be provided, a pair of two projections also may be provided to be opposed to each other (which will be described later), or three or more projections also may be provided on the circumference. A pair of projections are preferably used because a pair of projections can apply a turning force to the external cylinder with a good balance. On the other hand, three or more projections depend on the outer diameter of the second housing in order to form a rail groove for guiding a projection. However, a spatial limitation may be caused.

As described later, the rail groove may include the second straight rail groove extending in parallel with the axial direction from the opposite side of the end face of the connection end to the end face of the connection end. The rail groove also may include a helical groove providing communication between an end point of the first straight rail groove and a start point of the second straight rail groove and extending from an opposite side of an end face of the connection end to an end face of the connection end.

For example, the connection end including the rail groove may be considered as a cam having a curved or straight contact face. The external cylinder in which the projection protrudes may be considered as a cam follower having a contact with the curved face of the cam. The connection end and the external cylinder may be considered as constituting a cam apparatus. The connection end and the external cylinder also may be considered as constituting a three-dimensional cam. A three-dimensional cam is generally structured so that a groove is provided along a curved line on the surface of a rotating body having a center at the cam axis line and a cam follower guided by this groove can have a specific movement. The three-dimensional cam according to the present invention is classified to the so-called cylindrical cam in which a rotating body has a cylindrical shape.

For example, the rail groove is formed to have a square shape and both opposing side walls of the square groove guide the outer circumference of the projection. The tip end of the projection may be, for example, slid while being abutted with the bottom face of the rail groove. The tip end of the projection and the bottom face of the rail groove may have therebetween a minute gap. The first and second elastic pieces and a minute projection for example (which will be described later) are provided at predetermined positions at the bottom face of the rail groove.

For example, the projection also functions as a key that is engaged with a key groove in order to guide a pair of connectors when the connectors are joined. The first straight rail groove functions as a key groove for preventing wrong insertion and for providing polarity. Thus, the first connecting device can be inserted into the second connecting device by positioning the projection and the first straight rail groove.

For example, the projection inserted into the first straight rail groove can return, until the projection goes over the first elastic piece provided at the end point of the first straight rail groove, to the start point of the first straight rail groove. Specifically, the first connecting device can be withdrawn from the second connecting device. When the projection reaches the end point of the first straight rail groove, the projection can be moved to the helical groove.

Here, the helical groove extending from the opposite side of the end face of the connection end to the end face of the connection end includes a structure in which, when the external cylinder is seen from the opposite side of the end face of the connection end while the external cylinder being seen as a fixed side, the helical groove advances in the clockwise direction so that an outside helix female thread (so-called right-handed screw) is formed at the outer circumference of the connection end. Alternatively, the helical groove also may include a structure in which, when the external cylinder is rotated in the counter-clockwise direction when the connection end (i.e., the second connecting device) is assumed as a fixed side and the external cylinder is seen from the opposite side of the opening, the helical groove is formed at the outer circumference of the connection end so that the first connecting device has a helical motion to the second connecting device so that the former is away from the latter.

As described above, when the external cylinder is rotated in one direction, the projection is guided by the helical groove and the first connecting device can be moved away from the second connecting device. Then, the projection can reach the end point of the helical groove. It is noted that the projection also can return, until the projection returns to the end point of the helical groove, to the start point of the helical groove. When the projection reaches the end point of the helical groove (i.e., the start point of the second straight rail groove), the first connecting device can be pulled out from the second connecting device in parallel with the axial direction.

Furthermore, the connector according to the first aspect of the present invention as described above includes, in order to lock the projection, a first lancet-shaped elastic piece provided at the end point of the first straight rail groove. When the first connecting device is inserted into the second connecting device, the projection is locked to the first elastic piece and the first connecting device is connected to the second connecting device. When the first connecting device is rotated to the second connecting device and is withdrawn, the first connecting device and the second connecting device are disengaged from each other.

For example, the first elastic piece may include a slope protruding from the start point of the first straight rail groove to the end point. This slope is continuous from the bottom face of the first straight rail groove and the tip end of the slope includes a step for locking the projection. When the projection is abutted with the first elastic piece, the first elastic piece elastically deforms and deflects. When the projection goes over the first elastic piece and reaches the end point of the first straight rail groove, the first elastic piece recovers and the projection is locked to the first lancet-shaped elastic piece. The lancet-shaped elastic piece as described above also may be called as a lance. Thus, the backset of the projection can be prevented.

The projection also may be considered as a detent. The end point of the first straight rail groove provided at the latter part of the first elastic piece (which has a concave shape) may be considered as an indent. The detent and the indent may be considered as constituting a lock mechanism. Thus, a correct joint relation between the first connecting device and the second connecting device is maintained. When the first connecting device is rotated to the second connecting device and is withdrawn in a direction along which the first connecting device is away from the second connecting device, the first connecting device and the second connecting device are disengaged from each other.

As described above, the connector according to the first aspect of the present invention can conveniently provide, by moving the first connecting device and the second connecting device closer to each other in the axial direction and engaging (or connecting) the first connecting device and the second connecting device, a faster and easier connection than that by the conventional structure by a rotational operation. When the projection goes over the first elastic piece and reaches the end point of the first straight rail groove, clicking sound or click feeling by the recovery of the first elastic piece also can be felt. Thus, a correct connection between the first connecting device and the second connecting device can be confirmed by the clicking sound or click feeling.

On the other hand, the connector according to the first aspect of the present invention has a structure in which, after the rotation of the external cylinder, the first connecting device and the second connecting device are moved away from each other so that first connecting device and the second connecting device are separated from each other. Thus, it is also possible to secure, after mutual signal terminals included in the first and second terminal groups are disengaged and before the mutual signal terminals included in the first and second terminal groups are disengaged, a time required for turning OFF the power source. This structure prevents, when the mutual power source terminals are disengaged, spark from being caused, thus preventing the power source terminal from deteriorating.

For example, the first connecting device or the second connecting device can include a detection circuit for detecting that the connection of mutual signal terminals is cancelled so that a hardware switch or a software switch operating based on a transmission signal from this detection circuit is used to turn OFF a power source supplied to a power source terminal, thereby providing the so-called auto power off operation. For example, in the connector according to the first aspect of the present invention, mutual signal terminals are separated in the middle of the rotation of the external cylinder and a time required for an auto power off operation is much shorter than a time required by a manual operation for cutting off the mutual power source terminals. Thus, the power source can be turned OFF before a mechanical connection between the mutual power source terminals is cut off.

The second aspect of the present invention provides: a connector in which the first connecting device and the second connecting device are attachable and detachable with respect to each other, wherein, the first connecting device comprises: an external cylindrical cylinder, a first substantially columnar housing rotatably retained in an inner circumference of this external cylinder, and a first terminal group that is retained in the first housing and that is stored in an opening at one end of the external cylinder, the second connecting device includes: a second housing having a substantially cylindrical connection end that can be inserted into the opening at one end of the external cylinder, and a second terminal group that is stored in the connection end and that is connected with the first terminal group, the external cylinder has one or more projections elastically protruding from an inner wall of one end of the external cylinder, an outer circumference of the connection end includes rail grooves for guiding the projections, the rail groove includes a first straight rail groove extending in parallel with the axial direction from one end of the connection end to the other end, and a wedge-shaped ridge section having a step for locking the projection is provided at an end point of the first straight rail groove, and when the first connecting device is inserted into the second connecting device, the projection is locked to the wedge-shaped ridge section to connect the first connecting device with the second connecting device and, when the first connecting device is rotated to the second connecting device and is withdrawn, the first connecting device and the second connecting device are disengaged from each other.

The connector according to the second aspect is different from the connector according to the first aspect of the present invention in that, while the connector according to the first aspect of the invention has one or more projections protruding from the inner wall at one end of the external cylinder, the connector according to the second aspect of the invention has one or more projections elastically protruding from the inner wall of one end of the external cylinder. Another difference between the connector according to the first aspect of the invention and the connector according to the second aspect of the invention is that, while the connector according to the first aspect of the present invention includes the first lancet-shaped elastic piece for locking the projection provided at the end point of the first straight rail groove, the connector according to the second aspect includes the wedge-shaped ridge section having a step for locking the projection provided at the end point of the first straight rail groove.

Specifically, while the connector according to the first aspect of the present invention is a detent consisting of a projection fixed to the inner wall of the external cylinder, the connector according to the second aspect of the invention may be considered as a detent elastically protruding from the inner wall of the external cylinder. Another difference is that, while the connector according to the first of the invention is structured so that the end point of the first straight rail groove provided at the latter part of the first elastic piece constitutes an indent, the connector according to the second aspect of the invention may be considered to have a structure in which the end point of the first straight rail groove provided at the latter part of the wedge-shaped ridge section protruding from the first straight rail groove to have a wedge-like shape constitutes an indent. The detent and the indent may be considered as constituting a lock mechanism.

For example, the inner wall of one end of the external cylinder includes a tongue piece that is inclined from the opposite side of the opening of the external cylinder to the opening in the central axis direction. The base end of the tongue piece is elastically supported, in a cantilever-like manner, by the inner wall of one end of the external cylinder. The tip end section of the tongue piece includes a projection.

For example, the wedge-shaped ridge section may be formed by a slope protruding from the start point of the first straight rail groove to the end point. This slope is continuous from the bottom face of the first straight rail groove and the tip end of the slope includes a step to be locked to the projection. When the projection is abutted with the wedge-shaped ridge section, the tongue piece elastically deforms and deflects. When the projection goes over the wedge-shaped ridge section and reaches the end point of the first straight rail groove, the tongue piece recovers and the projection is locked to the step of the wedge-shaped ridge section. The tongue piece is also called as a lance. Thus, the backset of the projection can be prevented.

As described above, the connector according to the second aspect includes the wedge-shaped ridge section having a step for locking the projection that is provided at the end point of the first straight rail groove. When the first connecting device is inserted into the second connecting device, the projection is locked to the wedge-shaped ridge section having a step, thereby providing the connection between the first connecting device and the second connecting device. When the first connecting device is rotated to the second connecting device and is withdrawn in a direction along which the first connecting device is away from the second connecting device, the first connecting device and the second connecting device are mutually disengaged.

According to the third aspect of the present invention, the connector according to the first aspect or the second aspect of the present invention, the rail groove includes: a second straight rail groove extending in parallel with the axial direction from an opposite side of an end face of the connection end to an end face the connection end, and a helical groove providing communication between an end point of the first straight rail groove and a start point of the second straight rail groove and extending from an opposite side of an end face of the connection end to an end face of the connection end.

The fourth aspect of the present invention will be described below. In the connector according to the third aspect of the present invention, a minute projection is provided in the vicinity of a start point of the helical groove. This minute projection suppresses, when the projection reaches the end point of the first straight rail groove, the projection from being moved to the helical groove.

For example, the minute projection is protruded to have a half-columnar or mountain range-like shape so that a weir is provided at the bottom face of a helical groove. For example, when the projection reaches the end point of the first straight rail groove, the external cylinder (projection) is stopped by the minute projection so long as the external cylinder does not receive a turning force, thus maintaining the joint status between the first connecting device and the second connecting device. By rotating the external cylinder with a strong force to cause the projection to go over the minute projection, the projection is moved to the helical groove, thereby starting a separating movement to move the first connecting device away from the second connecting device. It is noted that the start point of the helical groove and the end point of the first straight rail groove may be at the same portion and the linear motion of the projection is converted to a helical motion.

As described above, the existence of the minute projection provided in the vicinity of the start point of the helical groove maintains, so long as the external cylinder does not receive a turning force, the joint status between the first connecting device and the second connecting device. It is noted that the existence of this minute projection also may provide an effect according to which a strong torque is felt when the rotation of the external cylinder is started and the decrease in the torque is felt when the projection goes over the minute projection.

According to the fifth aspect of the present invention, in the connector according to the third aspect or the fourth aspect of the present invention, a second lancet-shaped elastic piece is provided in the vicinity of the end point of the helical groove and, the second elastic piece prevents the projection from returning to the helical groove when it reaches the start point of the second straight helical groove.

For example, the second elastic piece may include a slope protruding from the start point of the helical groove to the end point. This slope is continuous from the bottom face of the helical groove and a part after the tip end of the slope includes a step for locking the projection. When the projection is abutted with the second elastic piece, the second elastic piece elastically deforms and deflects. When the projection goes over the second elastic piece and reaches the start point of the second straight rail groove, the second elastic piece recovers to prevent the projection from returning to the helical groove. The second elastic piece also may be called as a lance. It is noted that the end point of the helical groove and the start point of the second straight rail groove may be at the same portion and the helical motion of the projection is converted to a linear motion.

According to the sixth aspect of the present invention, in the connector according to any of the third aspect to the fifth aspect of the present invention, the first connecting device includes one or more compression coil springs in each of which one end is locked to the other end of the external cylinder and the other end is locked to the other end of the first housing and the compression coil springs bias the projections engaged with the helical grooves so that the projections are rotated to the first straight rail groove.

In the connector according to the sixth aspect, when the external cylinder is released in the middle of the disengagement of the first connecting device and the second connecting device (i.e., in the middle of the engagement of the projections and the helical grooves), the connector is provided so that a biasing force by the compression coil springs can allow the first connecting device and the second connecting device to return to a joint status. It is noted that the compression coil springs also have a function to provide a biasing force for preventing the external cylinder from being away from the first housing. Alternatively, one compression coil spring, a pair of two coil springs opposed to each other, or three or more coil springs provided at the circumference with equal intervals also may be used. However, a pair of compression coil springs is preferably used because a pair of compression coil springs can apply a turning force to the external cylinder with a good balance.

According to the seventh aspect of the present invention, in the connector according to any of the third aspect to the sixth aspect of the present invention, the first terminal group includes a plurality of first power source terminals and first signal terminals, the second terminal group includes a plurality of second power source terminals and second signal terminals, the first and second power source terminals and the first and second signal terminals are arranged so that the connections thereamong are cancelled in a nonsimultaneous and tandem manner, in the middle of the movement of the projection in the helical groove, the connection between the first and second signal terminals is cancelled and the connection between the first and second power source terminals is maintained, and in the middle of the movement of the projection in the second straight rail groove, the connection between the first and second power source terminals is cancelled.

According to the connector according to the seventh aspect, the first terminal group includes a plurality of first power source terminals and a plurality of first signal terminals. The second terminal group includes a plurality of second power source terminals and a plurality of second signal terminals. The first and second power source terminals and the first and second signal terminals are arranged so that the connections thereamong are cancelled in a nonsimultaneous and tandem manner.

The first and second power source terminals may be a contact for transmitting electric power. Electric power can be transmitted by mutually connecting the first and second power source terminals. For example, this power may be supplied from a DC power source by a battery. The first and second signal terminals may be a terminal (contact) for transmitting an electrical signal. An electrical signal can be transmitted by mutually connecting the first and second signal terminals. For example, this electrical signal may be a control signal for controlling an actuator. The connector including two or more types of contacts such as a power source and an electrical signal is called as a Hybrid Connector.

For example, a part of the first housing includes a plurality of square pole-like piece having contact cavities that are provided in the external cylinder in a protruding manner. This square pole-like piece may include therein the first power source terminal forming a tuning-fork shaped contact (also called as forked contact). For example, the first power source terminal may be a crimp contact for crimping an electric wire. On the other hand, a part of the second housing includes a plurality of tubular pieces that are engaged with the square pole-like pieces and that are provided in an opening. The tubular pieces may include therein the second power source terminal that is a pin contact. For example, the second power source terminal may be a crimp contact for crimping an electric wire. Thus, the first power source terminal and the second power source terminal are inserted and withdrawn.

For example, a part of the first housing includes a flat plate piece that is included in the external cylinder in a protruding manner. The flat plate piece has thereon the first signal terminals functioning as a plurality of plate-like contacts. For example, an end of the first signal terminal may be connected with a flat cable. On the other hand, a part of the second housing includes the flat plate piece that is provided in the opening. The flat plate piece includes the second signal terminal arranged as a plurality of cantilever contacts. For example, an end of the second signal terminal may be connected with a flat cable. Thus, the first signal terminal and the second signal terminal are inserted and withdrawn.

In the connector according to the seventh aspect of the present invention, in the middle of the movement of the projection in the helical groove, the connection status between the first and second signal terminals is cancelled but the connection status between the first and second power source terminals is maintained. In the middle of the movement of the projection in the second straight rail groove, the connection status between the first and second power source terminals is cancelled.

For example, the grip section may include a monitor lamp to display a difference between the connection status and the no-connection status between the first and second power source terminals.

According to the eighth aspect of the present invention, in the connector according to any of the first aspect to the seventh aspect of the present invention, the one or more projections consist of two projection members and the projection members are provided as a pair so as to be opposed to an inner wall at one side of the external cylinder.

As described above, the reason why the projections are arranged to be opposed to each other at the inner wall of one end of the external cylinder is that this allows the external cylinder to be rotated with a good balance. The wording "good balance" herein includes, for example, a balanced force to prevent the central axis of the external cylinder from being dislocated and also includes the pair of the rail grooves for guiding the pair of the projections arranged at the outer circumference of the connection end with a good balance. For example, a connection end in a product in which the invention is practiced may have an outer diameter of 3 to 4 cm. Thus, providing three or more rail grooves at equal intervals is considered to be difficult. However, a connector having a connection end of a large diameter is not limited by the three or more rail grooves provided with equal intervals.

According to the ninth aspect of the present invention, in the connector according to any of the first aspect to the eighth aspect of the present invention, the other end of the external cylinder forms a grip section having an outer diameter larger than that of one end of the external cylinder.

This grip section may be designed so that the grip section can be easily gripped by fingers by a plurality of grooves provided in parallel in the axial direction.

The connector according to the present invention can conveniently provide, by moving the first connecting device and the second connecting device closer to each other in the axial direction and connecting the first connecting device and the second connecting device, a faster and easier connection than that by the conventional structure by a rotational operation. When the projection goes over the first elastic piece and reaches the end point of the first straight rail groove, click feeling by the recovery of the first elastic piece also can be felt. Thus, a correct connection between the first connecting device and the second connecting device can be confirmed by the click feeling.

On the other hand, the connector according to the invention has a structure in which, after the rotation of the external cylinder, the first connecting device and the second connecting device are moved away from each other so that the first connecting device and the second connecting device are separated from each other. Thus, it is also possible to secure, after mutual signal terminals included in the first and second terminal groups are disengaged and before the mutual signal terminals included in the first and second terminal groups are disengaged, a time required for turning OFF the power source. This structure prevents, when the mutual power source terminals are disengaged, spark from being caused, thus preventing the power source terminal from deteriorating.

DETAILED DESCRIPTION OF THE INVENTION

Hereinafter, preferred embodiments for carrying out the present invention will be described with reference to the drawings.

Figure 1:
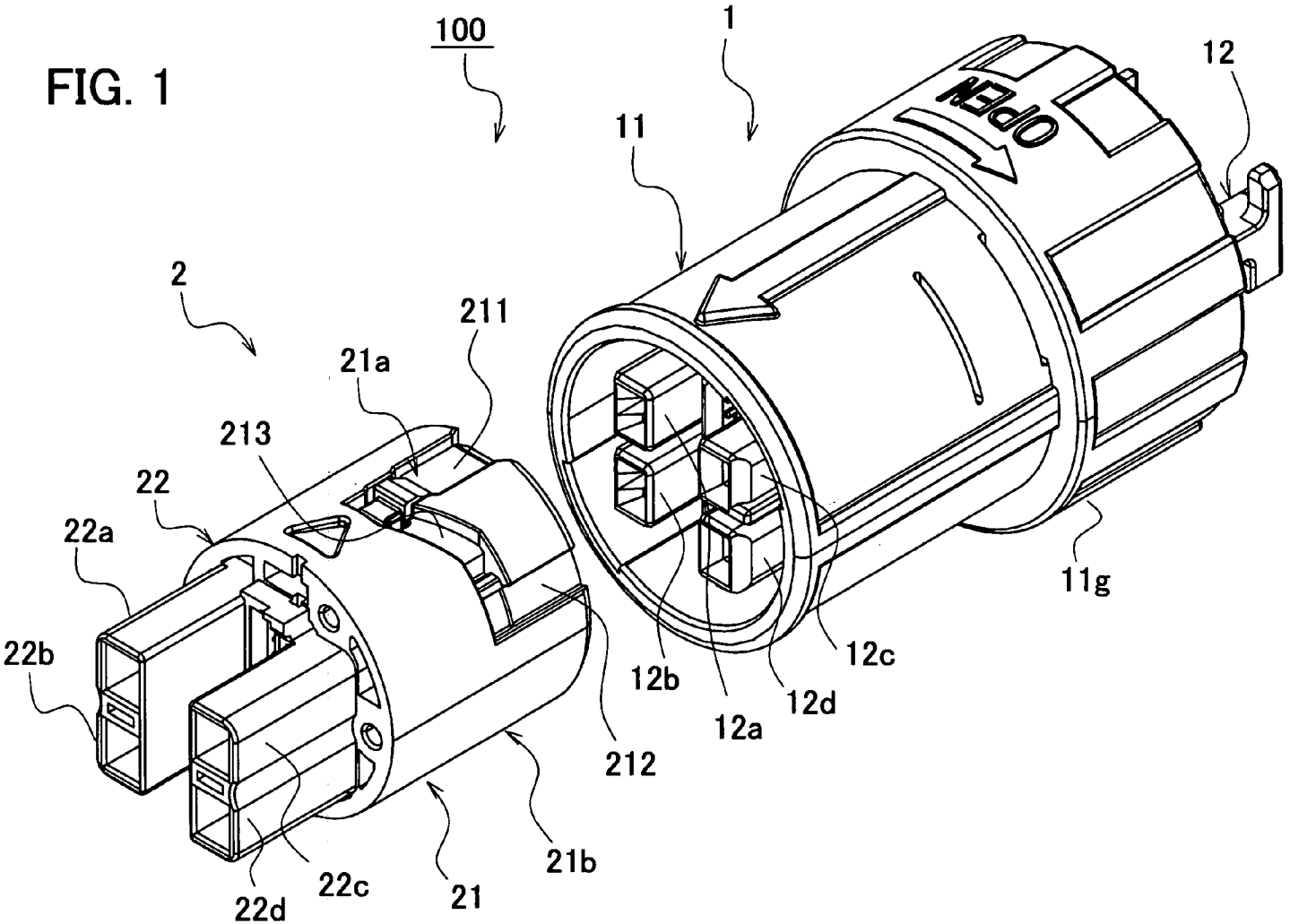
FIG. 1 is an external perspective view illustrating one embodiment of a connector according to the present invention.
Figure 2:
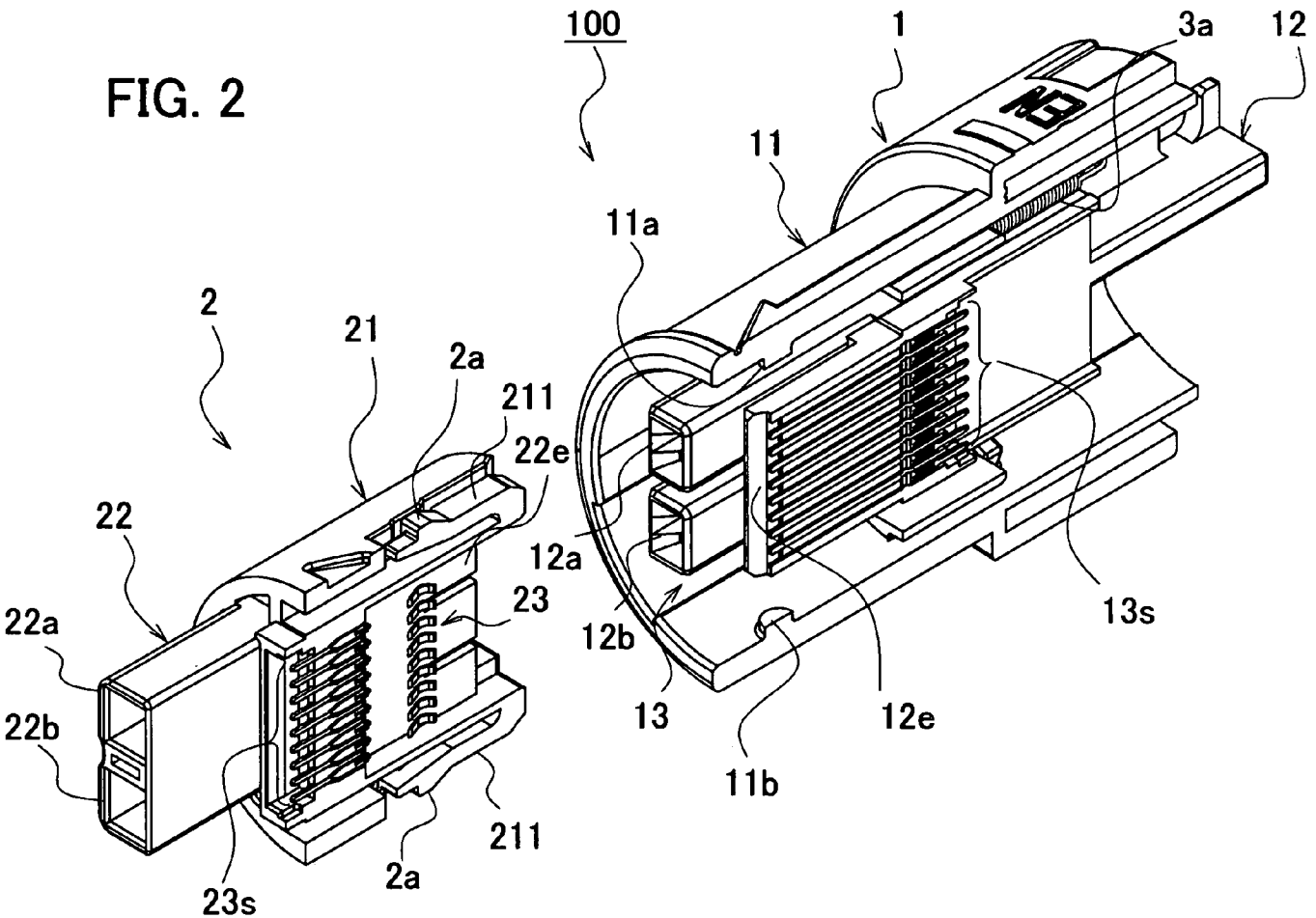
FIG. 2 is an external perspective view illustrating the connector according to the embodiment.
Figure 3:
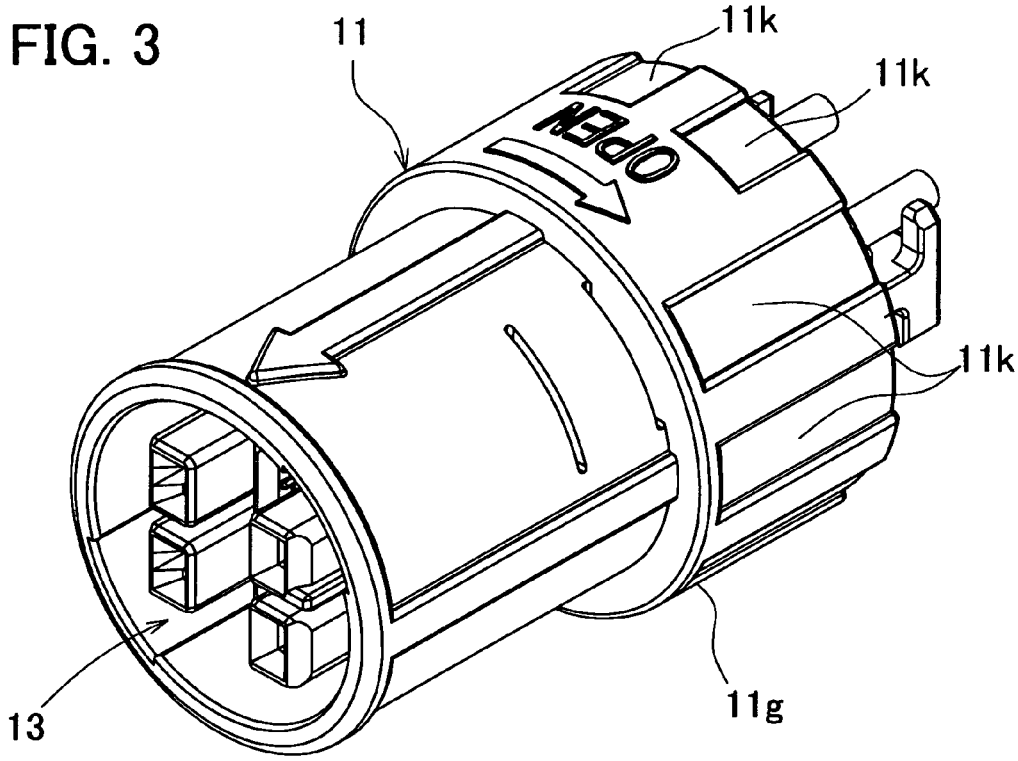
FIG. 3 is an external perspective view illustrating a first connecting device according to the embodiment.
Figure 4:
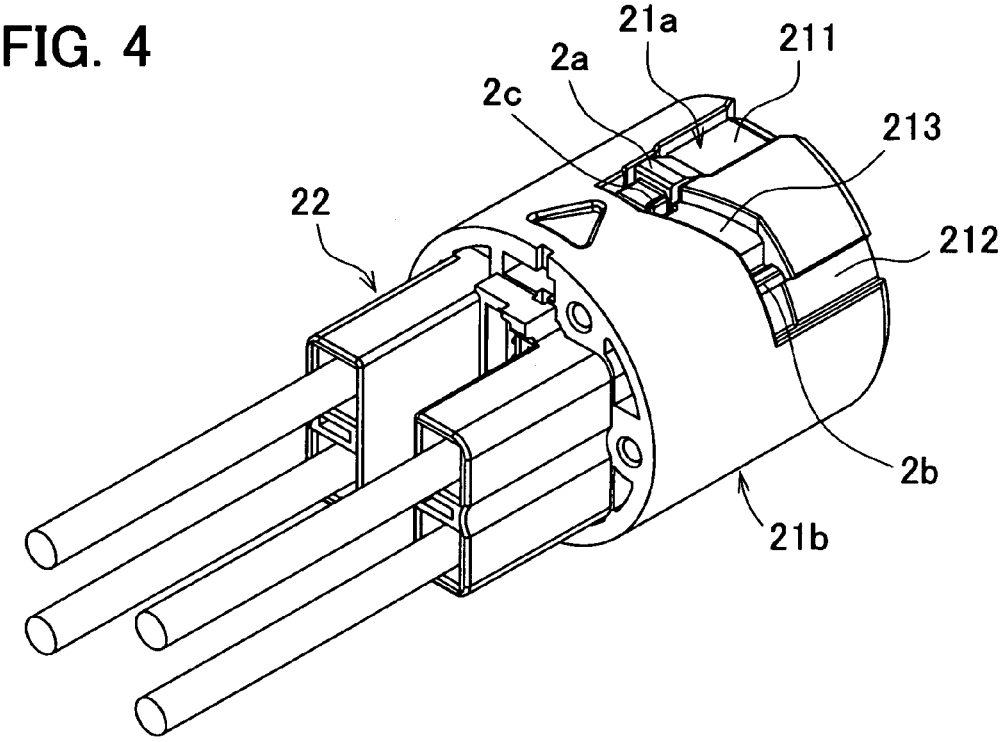
FIG. 4 is an external perspective view illustrating a second connecting device according to the embodiment.
Figure 5:
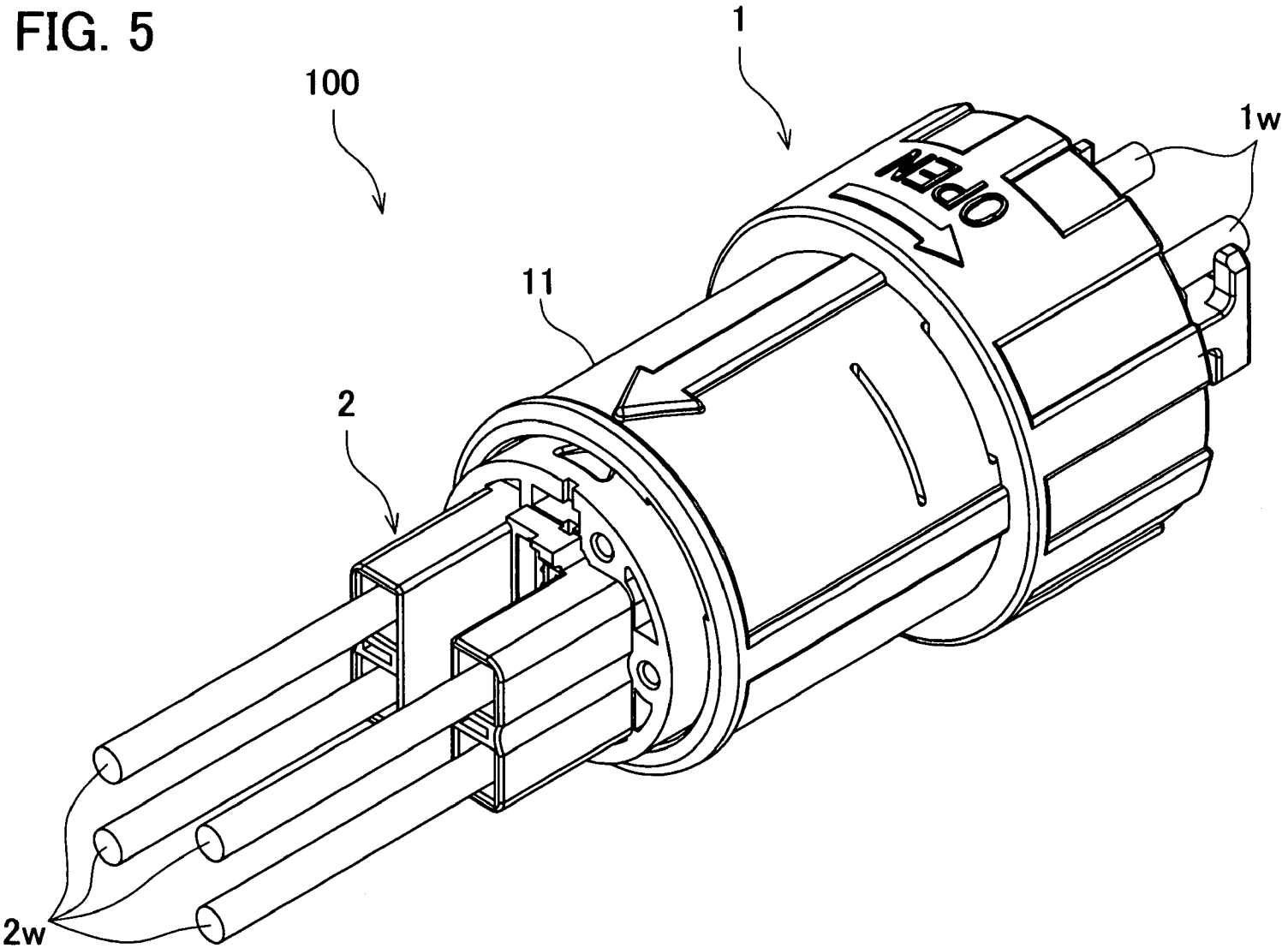
FIG. 5 is an external perspective view illustrating the connector according to the embodiment.

FIG. 1 is an external perspective view illustrating one embodiment of a connector according to the present invention. In FIG. 1, the first connecting device (hereinafter referred to as plug) is provided so as to be opposed to the second connecting device (hereinafter referred to as receptacle). FIG. 2 is an external perspective view illustrating the connector according to the embodiment. FIG. 2 is a longitudinal cross section showing the plug and the receptacle of FIG. 1. FIG. 3 is an external perspective view illustrating the plug according to the embodiment. FIG. 4 is an external perspective view illustrating the receptacle according to the embodiment. FIG. 5 is an external perspective view illustrating the connector according to the embodiment. FIG. 5 illustrates the plug and the receptacle being connected to each other.

Figure 6:
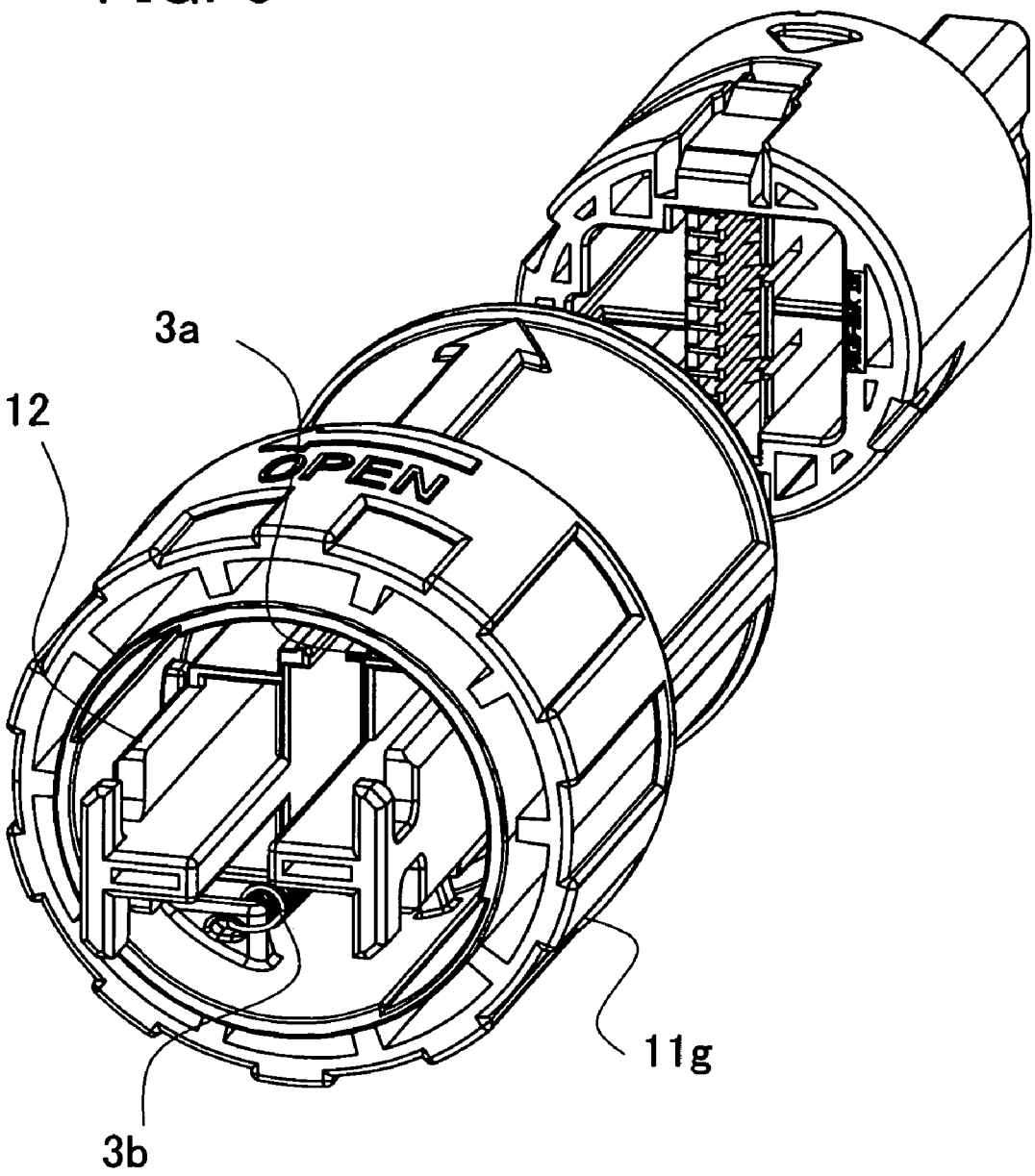
FIG. 6 is an external perspective view illustrating the connector according to the embodiment.
Figure 7:
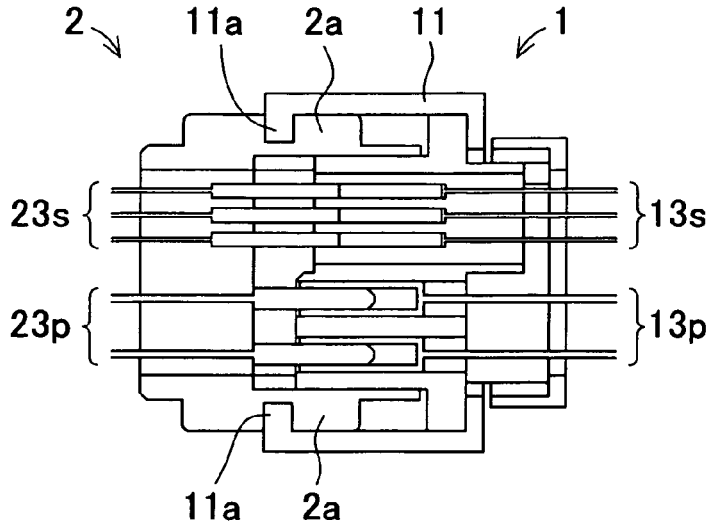
FIG. 7 is a longitudinal cross sectional view of the connector according to the another embodiment in which the first connecting device is connected to the second connecting device.
Figure 8:
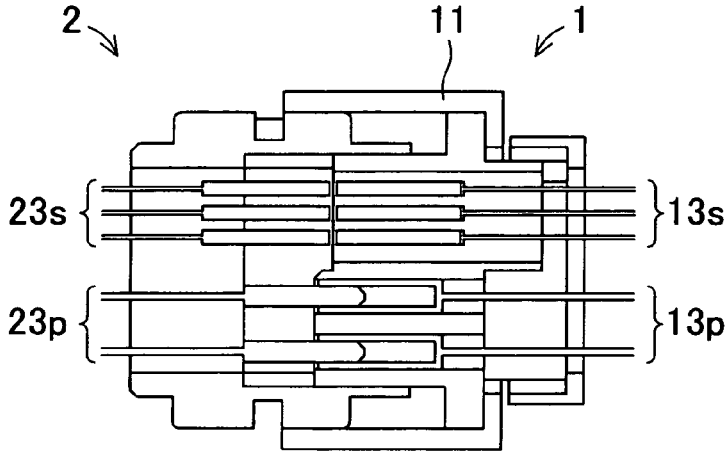
FIG. 8 is a longitudinal cross sectional view of the connector according to the embodiment in which the first connecting device is being moved away from the second connecting device.
Figure 9:
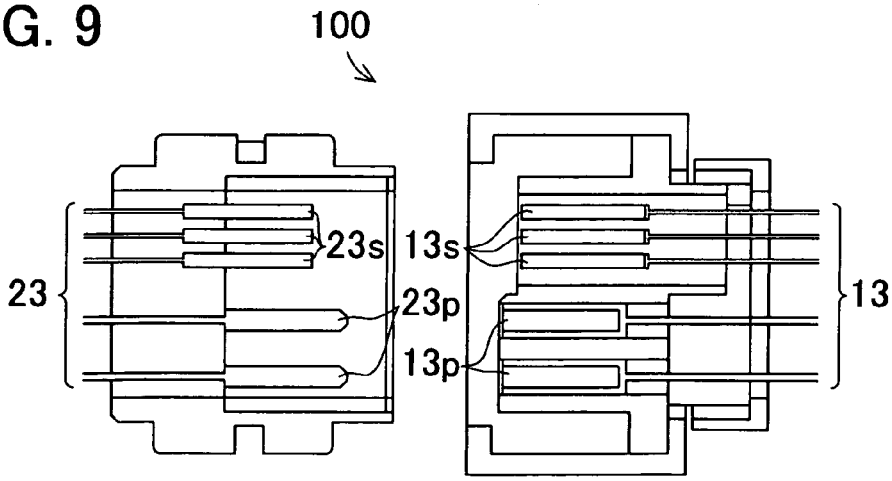
FIG. 9 is a longitudinal cross sectional view of the connector according to the embodiment in which the first connecting device is separated from the second connecting device.

FIG. 6 is an external perspective view illustrating the connector according to the embodiment. FIG. 6 shows the connector seen from a different direction from that of FIG. 1. FIG. 7 is a longitudinal cross sectional view illustrating the connector according to the embodiment. FIG. 7 illustrates the plug and the receptacle being connected. FIG. 8 is a longitudinal cross sectional view illustrating the connector according to the embodiment. FIG. 8 illustrates one the plug being moved away from the receptacle. FIG. 9 is a longitudinal cross sectional view illustrating the connector according to the embodiment. FIG. 9 illustrates the plug away from the receptacle.

Figure 10:
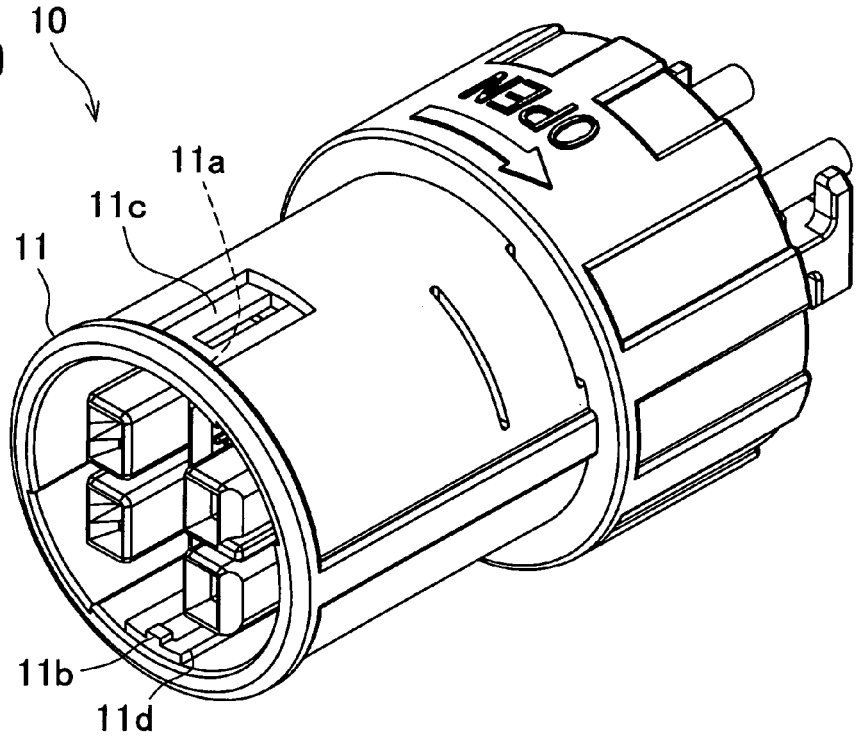
FIG. 10 is an external perspective view illustrating the first connecting device according to another embodiment.
Figure 11:
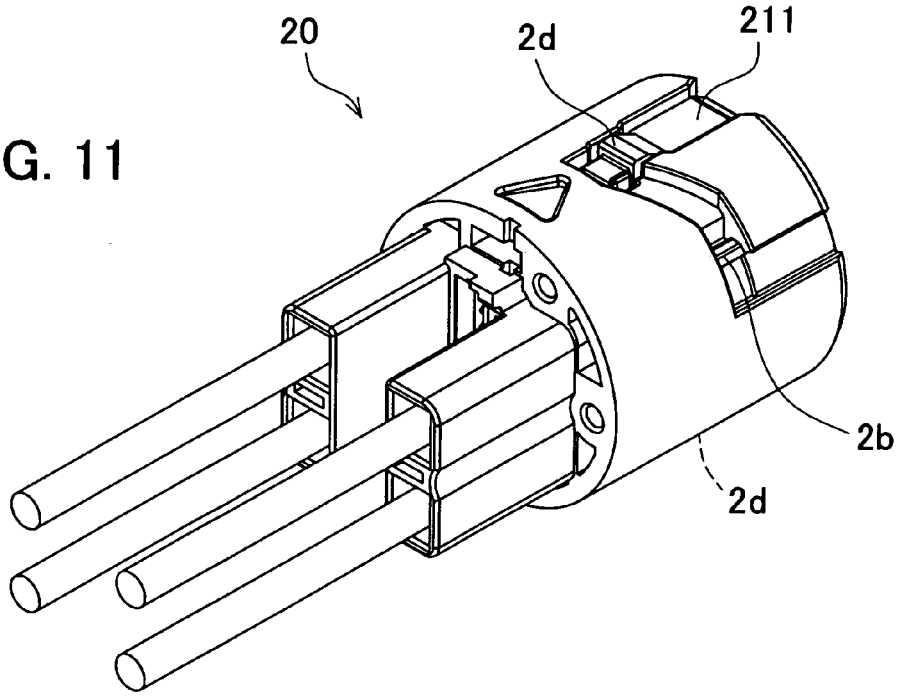
FIG. 11 is an external perspective view illustrating the second connecting device according to another embodiment.
Figure 12:
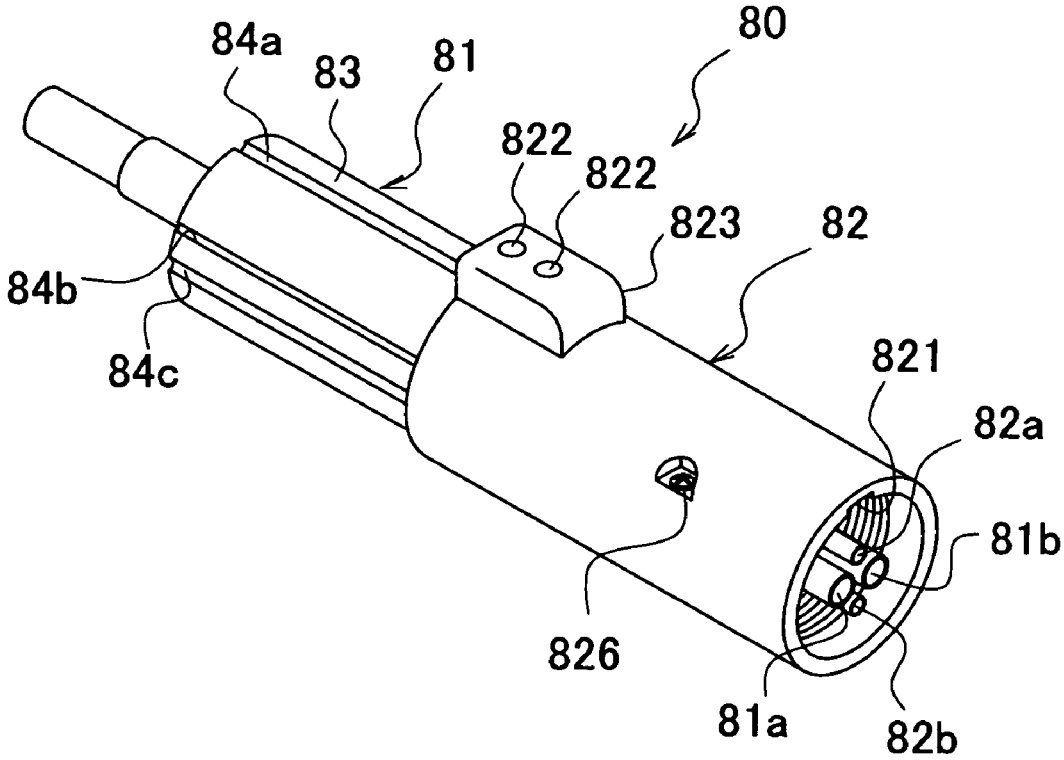
FIG. 12 is an external perspective view illustrating a charger-side plug using a connector having a rotation guide according to conventional technology.
Figure 13:
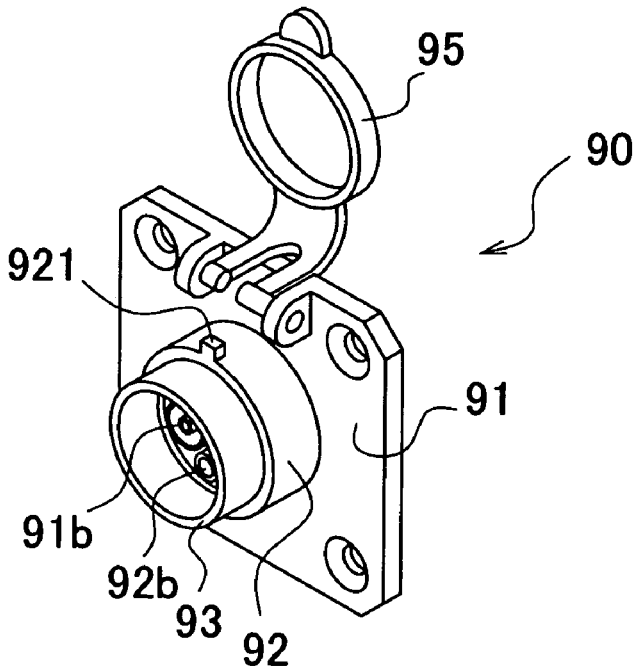
FIG. 13 is an external perspective view illustrating a capacitor-side receptacle according to conventional technology.

FIG. 10 is an external perspective view illustrating a plug according to another embodiment. FIG. 11 is an external perspective view illustrating a receptacle according to another embodiment.

First, the structure of the connector according to the present invention will be described. In FIG. 1 or FIG. 2, a plug 1 includes: a cylindrical external cylinder 11, the first housing 12 having a substantially columnar shape, and the first terminal group 13. The first housing 12 is retained in the inner circumference of the external cylinder 11 in a rotatable manner. The first terminal group 13 is retained in the first housing 12 and is stored in an opening at one end of the external cylinder 11. A receptacle 2 includes the second housing 22 and the second terminal group 23. The second housing 22 has a substantially cylindrical-shaped connection end 21 that can be inserted into the opening at one end of the external cylinder 11. The second terminal group 23 is stored in the connection end 21. The second terminal group 23 is connected to the first terminal group 13. The connector 100 is provided so that the plug 1 and the receptacle 2 can be attached to each other or detached from each other.

In FIG. 1 or FIG. 2, the plug 1 is a round multipolar connector that is connected with an electric wire and that includes the first housing 12 having a substantially columnar shape. The receptacle 2 is a round multipolar connector that is attached to a panel for example and that has a substantially cylindrical connection end 21. The first and second housings 12 and 22 may have an insulation property and may be a housing made of nonconductive material. The insulating housing having the shapes shown in FIG. 1 or FIG. 2 can be obtained by molding synthetic resin material. The first housing 12 and the second housing 22 may be made of the same insulating material or also may be made of different insulating materials. In order to provide the plug 1 to have a light weight, the external cylinder 11 is made of the same synthetic resin material as that of the first housing 12.

In FIG. 2, the first housing 12 is retained in the axial direction in the inner circumference of the external cylinder 11 so as not to be moved. The external cylinder 11 circulates in the forward and reverse directions by a predetermined angle. When the first housing 12 is fixed and the external cylinder 11 is rotated, the external cylinder 11 can be rotated from a position at which the external cylinder 11 is engaged with the second housing 22 to a position at which the engagement is cancelled. In FIG. 2, the external cylinder 11 is prevented from being rotated to the first housing 12 by a more-than-required angle by providing steps at the outer circumference of the first housing 12 and the inner circumference of the external cylinder 11, thereby regulating the rotation angle of the external cylinder 11.

In FIG. 3, one end of the external cylinder 11 has a circular opening that stores therein the first terminal group 13. In FIG. 4, the second housing 22 is structured so that the outer diameter of the connection end 21 is slightly smaller than the inner diameter of the external cylinder 11, thus providing an engagement between the connection end 21 and the external cylinder 11 in a detachable manner (see FIG. 2). The connection end 21 has a predetermined length so that the connection end 21 can be inserted into one end of the external cylinder 11. One end of the connection end 21 is opened and the connection end 21 stores therein the second terminal group 23 so that a part thereof protrudes (see FIG. 2). In FIG. 3, the other end of the connection end 21 also may include a flat plate like saddle so that the connection end 21 can be fixed to a panel.

In FIG. 2, there are a pair of columnar projections 11*a* and 11*b* that protrude from an inner wall of one end of the external cylinder 11. Although the projection 11*a* and the projection 11*b* have the same structure, they are denoted with different reference numerals for convenience of description. In FIG. 1, the outer circumference of the connection end 21 includes a pair of rail grooves 21*a* and 21*b* for guiding the pair of the projections 11*a* and 11*b*. The rail groove 21*a* includes the first straight rail groove 211 that extends in parallel with the axial direction from an end face of the connection end 21 to the opposite side of this end face. The rail groove 21*a* includes the second straight rail groove 212 that extends in parallel with the axial direction from the opposite side of the end face of the connection end 21 to the end face of the connection end 21. The rail groove 21*a* includes a helical groove 213 that provides communication between an end point of the first straight rail groove 211 and a start point of the second straight rail groove 212. The helical groove 213 extends from the opposite side of the end face of the connection end 21 to the-end face of the connection end 21. The rail groove 21*b* has a structure as described above and thus may not be further described hereinafter.

Next, the operation of the connector according to the present invention will be described with reference to the drawings.

In FIG. 1 and FIG. 2, the connection end 21 including the pair of the rail grooves 21*a* and 21*b* may be considered as a cam having a curved or straight contact face. The external cylinder 11 in which the pair of the projections 11*a* and 11*b* protruded may be considered as a cam follower having a contact with the curved face of the cam. The connection end 21 and the external cylinder 11 may be considered as constituting a cam apparatus.

As shown in FIG. 1, the rail groove 21*a* is formed to have a square shape and both side walls opposing to each other of the square rail groove 21*a* guide the outer circumference of the projection 11*a* (see FIG. 2). The tip end of the projection 11*a* may be provided, for example, so that the projection 11*a* can be slid while being abutted with the bottom face of the rail groove 21*a*. The tip end of the projection 11*a* and the bottom face of the rail groove 21*a* may have therebetween a minute gap. The first and second elastic pieces 2*a* and 2*b* and a minute projection 2*c* are provided at predetermined positions at the bottom face of the rail groove 21*a*.

In FIG. 1 and FIG. 2, the pair of the projections 11*a* and 11*b* also functions as a key that is engaged with a key groove in order to guide the plug 1 and the receptacle 2 when the plug 1 is joined with the receptacle 2. A pair of first straight rail grooves 211 can function as a key groove for preventing wrong insertion and for providing polarity. The plug 1 can be inserted into the receptacle 2 by positioning the pair of the projections 11*a* and 11*b* and the pair of first straight rail grooves 211.

In FIG. 1 and FIG. 2, the projection 11*a* inserted into the first straight rail groove 211 can return, until the projection 11*a* goes over the first elastic piece 2*a* provided in the vicinity of the end point of the first straight rail groove 211, to the start point of the first straight rail groove 211, for example. Specifically, the plug 1 can be withdrawn from the receptacle 2. When the projection 11*a* reaches the end point of the first straight rail groove 211, the projection 11*a* can be moved to the helical groove 213.

In FIG. 1 and FIG. 2, the helical groove 213 extends from the opposite side of the connection end 21 to the end face of the connection end 21. When the external cylinder 11 is seen from the opposite side of the end face of the connection end 21 while the external cylinder 11 being seen as a fixed side, the outer circumference of the connection end 21 includes an outside helix female thread (so-called right-handed screw) along which the helical groove 213 advances in the clockwise direction. When the external cylinder 11 is seen from the opposite side of the opening while the connection end 21 (i.e., receptacle 2) being seen as a fixed side and when the external cylinder 11 is rotated in the counterclockwise direction, the helical groove 213 is formed in the outer circumference of the connection end 21 so that the plug 1 has a helical motion in a direction along which the plug 1 is away from the receptacle 2.

When the external cylinder 11 is rotated in one direction in FIG. 1 and FIG. 2, the pair of the projections 11*a* and 11*b* are guided by a pair of helical grooves 213 and the plug 1 can have a helical motion in a direction along which the plug 1 is away from the receptacle 2. Then, the pair of the projections 11*a* and 11*b* can reach the end points of the pair of helical grooves 213. It is noted that the pair of the projections 11*a* and 11*b* also can be returned to the start points of the pair of helical grooves 213 until the projections 11*a* and 11*b* reach the end points of the pair of helical grooves 213. When the pair of the projections 11*a* and 11*b* reach the end points of the helical grooves 213 (i.e., the start points of the pair of the second straight rail grooves 212), the plug 1 can be pulled out from the receptacle 2 in parallel with the axial direction.

In FIG. 2, in order to lock the pair of the projections 11*a* and 11*b*, a pair of lancet-shaped first elastic pieces 2*a* are provided at the end points of the pair of first straight rail grooves 211 (see FIG. 4). When the plug 1 is inserted into the receptacle 2, the pair of projections are locked to the pair of first elastic pieces 2*a* to connect the plug 1 with the receptacle 2 (see FIG. 5). When the plug 1 is rotated to the receptacle 2 and is withdrawn in a direction along which the plug 1 is away from the receptacle 2, the plug 1 and the receptacle 2 are mutually disengaged (see FIG. 1).

In FIG. 2, the first elastic piece 2*a* includes a slope protruding from the start point of the first straight rail groove 211 to the end point for example. This slope continues from the bottom face of the first straight rail groove 211. A tip end of this slope includes a step to be locked with the projection 11*a*. When the projection 11*a* is abutted with the first elastic piece 2*a*, the first elastic piece 2*a* elastically deforms and deflects. When the projection 2*a* goes over the first elastic piece 2*a* and reaches the end point of the first straight rail groove 211, the first elastic piece 2*a* recovers and the projection 11*a* is locked to the lancet-shaped first elastic piece 2*a*. The lancet-shaped elastic piece as described above also may be called as a lance. Thus, the backset of the projection 11*a* can be prevented.

In FIG. 1 and FIG. 2, the projection 11*a* can be considered as a detent. The end point of the first straight rail groove 211 provided at the latter part of the first elastic piece 2*a* (which has a concave shape) may be considered as an indent. These detent and indent may be considered as constituting a lock mechanism. Then, a correct joint relation between the plug 1 and the receptacle 2 is maintained (see FIG. 5). When the plug 1 is rotated to the receptacle 2 and is withdrawn in a direction along which the plug 1 is away from the receptacle 2, the plug 1 and the receptacle 2 are mutually disengaged (see FIG. 1).

As described above, the connector according to the present invention allows the plug 1 and the receptacle 2 to be engaged (or connected) to each other by moving the plug 1 and the receptacle 2 toward each other in the axial direction. Thus, the connector according to the present invention can conveniently provide a faster and easier connection than that by the conventional structure by a rotational operation. It is also possible that, when the projection 11*a* goes over the first elastic piece 2*a* and reaches the end point of the first straight rail groove 211, the first elastic piece 2*a* recovers to provide clicking sound or click feeling. Thus, the clicking sound or click feeling can be used to confirm that the plug 1 is correctly connected with the receptacle 2.

In FIG. 4, the minute projection 2*c* is provided in the vicinity of the start point of the helical groove 213. The minute projection 2*c* suppresses, when the projection 11*a* reaches the end point of the first straight rail groove 211, the projection 11*a* from being moved to the helical groove 213. The minute projection 2*c* protrudes to have a half-columnar or mountain range-like shape so as to provide a weir at the bottom face of the helical groove 213.

In FIG. 5, when the projection 11*a* reaches the end point of the first straight rail groove 211, the projection 11*a* is stopped by the minute projection 2*c* so long as the external cylinder 11 does not receive a turning force, thus maintaining the joint status between the plug 1 and the receptacle 2. By rotating the external cylinder 11 with a strong force to cause the projection 11*a* to go over the minute projection 2*c*, the projection 11*a* is moved to the helical groove 213, thereby starting a separating movement to move the plug 1 away from the receptacle 2. It is noted that the start point of the helical groove 213 and the end point of the first straight rail groove 211 may be at the same portion and the linear motion of the projection 11*a* is converted to a helical motion.

As described above, the existence of the minute projection 2*c* provided in the vicinity of the start point of the helical groove 213 maintains, so long as the external cylinder 11 does not receive a turning force, the joint status between the plug 1 and the receptacle 2. It is noted that the existence of the minute projection 2*c* also may provide an effect according to which a strong torque is felt when the rotation of the external cylinder 11 is started and the decrease in the torque is felt when the projection 11*a* goes over the minute projection 2*c*.

In FIG. 4, the second elastic piece 2*b* having a lancet-like shape is provided in the vicinity of the end point of the helical groove 213. The second elastic piece 2*b* prevents, when the projection 11*a* reaches the start point of the second straight rail groove 212, the projection 11*a* from returning to the helical groove 213.

In FIG. 4, the second elastic piece 2*b* includes a slope protruding from the start point of the helical groove 213 to the end point. This slope is continuous from the bottom face of the helical groove and a part after the tip end of the slope includes a step for locking the projection 11*a*. When the projection 11*a* is abutted with the second elastic piece 2*b*, the second elastic piece 2*b* elastically deforms and deflects. When the projection 11*a* goes over the second elastic piece 2*b* and reaches the start point of the second straight rail groove 212, the second elastic piece 2*b* recovers to prevent the projection 11*a* from returning to the helical groove 213. The second elastic piece also may be called as a lance. It is noted that the end point of the helical groove 213 and the start point of the second straight rail groove 212 may be at the same portion and the helical motion of the projection 11*a* is converted to a linear motion.

In FIG. 2, the pair of the projections 11*a* and 11*b* are arranged to be opposed to each other. The reason why the projections 11*a* and 11*b* are arranged to be opposed to each other is that this allows the external cylinder 11 to be rotated with a good balance. The wording "good balance" herein includes, for example, a balanced force to prevent the central axis of the external cylinder 11 from being dislocated and also includes the pair of the rail grooves 21*a* and 21*b* for guiding the pair of the projections 11*a* and 11*b* that are arranged at the outer circumference of the connection end 21 with a good balance (see FIG. 1 or FIG. 4). For example, a connection end in a product in which the invention is practiced may have an outer diameter of 3 to 4 cm. Thus, providing three or-more rail grooves at equal intervals is considered to be difficult. However, a connector having a connection end of a large diameter is not limited by the three or more rail grooves provided with equal intervals.

In FIG. 1 or FIG. 3, the other end of the external cylinder 11 includes a grip section 11*g* that has an outer diameter larger than that of one end of the external cylinder 11. The grip section 11*g* is designed so as to be easily gripped by fingers by a plurality of grooves 11*k* provided in parallel with the axial direction (see FIG. 3).

The plug 1 includes a pair of compression coil springs 3*a* and 3*b* in which one end is locked to the other end of the external cylinder 11 and the other end is locked to the other end of the first housing 12 (see FIG. 2 and FIG. 6). Although the compression coil spring 3*a* and the compression coil spring 3*b* have the same structure, they are denoted with different reference numerals for convenience of description. The pair of compression coil springs 3*a* and 3*b* bias the pair of the projections 11*a* and 11*b* engaged with the pair of helical grooves 213 so that the projections 11*a* and 11*b* are rotated toward the pair of first straight rail grooves 211 (see FIG. 2 and FIG. 4).

In FIG. 5, when the external cylinder 11 is released in the middle of the disengagement of the plug 1 and the receptacle 2 (i.e., in the middle of the engagement of the pair of the projections 11*a* and 11*b* and the pair of helical grooves 213), the connector 100 is provided so that a biasing force by the pair of compression coil springs 3*a* and 3*b* can allow the plug 1 and the receptacle 2 to return to a joint status. It is noted that the pair of compression coil springs 3*a* and 3*b* also have a function to provide a biasing force for preventing the external cylinder 11 from being away from the first housing 12 (see FIG. 2). Alternatively, one compression coil spring, a pair of coil springs opposed to each other, or three or more coil springs provided at the circumference with equal intervals also may be used. However, a pair of compression coil springs are preferably used because a pair of compression coil springs can apply a turning force to the external cylinder 11 with a good balance.

In FIG. 9, the connector 100 is structured so that the first terminal group 13 includes a plurality of first power source terminals 13*p* and a plurality of first signal terminals 13*s*. The second terminal group 23 includes a plurality of second power source terminals 23*p* and a plurality of second signal terminals 23*s*. The respective tip end positions of the first and second power source terminals 13*p* and 23*p* are provided at different positions from those of the respective tip end positions of the first and second signal terminals 13*s* and 23*s* along a direction along which the plug 1 is inserted or withdrawn.

In FIG. 9, the first and second power source terminals 13*p* and 23*p* may be a contact for transmitting electric power. Electric power can be transmitted by mutually connecting the first and second power source terminals 13*p* and 23*p*. For example, this power may-be supplied from a DC power source by a battery. The first and second signal terminals 13*s* and 23*s* may be a contact for transmitting an electrical signal. An electrical signal can be transmitted by mutually connecting the first and second signal terminals 13*s* and 23*s*. For example, this electrical signal may be a control signal for controlling an actuator.

In FIG. 1 and FIG. 2, a part of the first housing 12 includes four square pole-like pieces 12*a* to 12*d* that have contact cavities and that are provided in the external cylinder 11 in a protruding manner. The square pole-like pieces 12*a* to 12*d* include therein the first power source terminal 13*p* that is a tuning-fork shaped contact for example. The first power source terminal 13*p* may be a crimp contact crimped to an electric wire 1*w* and allows the electric wire 1*w* to extend to the other end of the plug 1 (see FIG. 5). On the other hand, a part of the second housing 22 includes a plurality of tubular pieces 22*a* to 22*d* that are engaged with the square pole-like pieces 12*a* to 12*d* and that are provided in the opening. The tubular pieces 22*a* to 22*d* include therein the second power source terminal 23*p* that is a pin contact for example. The second power source terminal 23*p* may be a crimp contact crimped to the electric wire 2*w* and allows the electric wire 2*w* to extend to the other end of the receptacle 2 (see FIG. 5). Thus, the first power source terminal 13*p* and the second power source terminal 23*p* are inserted and withdrawn.

In FIG. 2, a part of the first housing 12 includes a flat plate piece 12*e* that is included in the external cylinder 11 in a protruding manner. The flat plate piece 12*e* has thereon the first signal terminals 13*s* functioning as a plurality of plate-like contacts. For example, an end of the first signal terminal 13*s* may be connected with a flat cable. On the other hand, a part of the second housing 22 includes the flat plate piece 22*e* that is provided in the opening. The flat plate piece 22*e* includes the second signal terminal 23*s* arranged as a plurality of cantilever contacts. For example, an end of the second signal terminal 23*s* may be connected with a flat cable. Thus, the first signal terminal 13*s* and the second signal terminal 23*s* are inserted and withdrawn.

Next, a cancelling operation of the connector 100 will be described with reference to FIG. 7 to FIG. 9.

In FIG. 7, the plug 1 and the receptacle 2 are provided so that the pair of the projections 11*a* and 11*b* are locked to the pair of first elastic pieces 2*a* to maintain the connection status between the first and second power source terminals 13*p* and 23*p* and to maintain the connection status between the first and second signal terminals 13*s* and 23*s*.

When the external cylinder 11 in the status shown in FIG. 7 is rotated in one direction, the pair of the projections 11*a* and 11*b* are guided by the pair of helical grooves 213 (see FIG. 1) and the plug 1 and the receptacle 2 are moved in a direction along which the plug 1 and the receptacle 2 are away from each other, thereby providing the status as shown in FIG. 8. In the middle of the movement of the pair of the projections 11*a* and 11*b* on the pair of helical grooves 213, the connection status of the first and second signal terminals 13*s* and 23*s* is cancelled as shown in FIG. 8 but the connection status of the first and second power source terminals 13*p* and 23*p* is maintained.

Then, when the pair of the projections 11*a* and 11*b* reach the start points of the pair of the second straight rail grooves 212 (see FIG. 1) and the plug 1 is withdrawn from the receptacle 2 in parallel with the axial direction, the connection status of the first and second power source terminals 13*p* and 23*p* is cancelled in the middle of the movement of the pair of the projections 11*a* and 11*b* in the pair of the second straight rail grooves 212.

As described above, the connector according to the present invention is structured so that the rotation of the external cylinder is followed by an operation for moving the plug and the receptacle away from each other to separate the plug and the receptacle from each other. Thus, it is also possible to secure, after mutual signal terminals included in the first and second terminal groups are disengaged and before the mutual signal terminals included in the first and second terminal groups are disengaged, a time required for turning OFF the power source. This structure prevents, when the mutual. power source terminals are disengaged, spark from being caused, thus preventing the power source terminal from deteriorating.

Next, the structure of the connector according to another embodiment will be described.

In FIG. 10, the plug 10 according to another embodiment has the pair of square pole-like projections 11*a* and 11*b* that elastically protrude from an inner wall of one end of external cylinder 11. On the other hand, in the receptacle 20 according to another embodiment in FIG. 11, a pair of wedge-shaped ridge sections 2*d* and 2*d* having steps for locking the pair of the projections 11*a* and 11*b* are provided at an end point of the first straight rail groove 211. When the plug 10 is inserted into the receptacle 20, the pair of the projections 11*a* and 11*b*are locked to the pair of wedge-shaped ridge sections 2*d* and 2*d* to connect the plug 10 to the receptacle 20.

The connector according to this another embodiment is different from the connector 100 according to the above-described embodiment having the pair of the projections 11*a* and 11*b* protruding from the inner wall of one end of the external cylinder 11 (see FIG. 2) in that the connector according to this another embodiment has the pair of the projections 11*a* and 11*b* that elastically protrude from the inner wall of one end of the external cylinder 11. The connector according to this another embodiment is also different from the connector 100 according to the above-described embodiment in that, while the connector 100 according to the above-described embodiment includes the first lancet-shaped elastic pieces 2*a* provided at the end points of the first straight rail groove 211 in order to lock the pair of the projections 11*a* and 11*b* (see FIG. 2), the connector according to this another embodiment includes the wedge-shaped ridge sections 2*d* and 2*d* having steps for locking the pair of the projections 11*a* and 11*b* that are provided at the end point of the first straight rail groove 211.

While the connector 100 according to the above-described embodiment is a detent consisting of the pair of the projections 11*a* and 11*b* fixed to the inner wall of the external cylinder 11, the connector according to this another embodiment may be considered as a detent that elastically protrudes from the inner wall of the external cylinder 11 and that consists of the pair of the projections 11*a* and 11*b*. While the connector 100 according to the above-described embodiment is structured so that the end point of the first straight rail groove 211 provided at the latter part of the first elastic piece 2*a* constitutes an indent, the connector according to this another embodiment may be considered to have a structure in which the end point of the first straight rail groove provided at the latter part of the wedge-shaped ridge section 2*d* protruding to have a wedge-like shape from the first straight rail groove 211 constitutes an indent. The detent and the indent may be considered as constituting a lock mechanism.

In FIG. 10, the inner wall of one end of the external cylinder 11 includes a pair of tongue pieces 11*c* and 11*d*. The pair of tongue pieces 11*c* and 11*d* is inclined from the opposite side of the opening of the external cylinder 11 to the opening toward the central axis direction. The base ends of the pair of tongue pieces 11*c* and 11*d* are elastically supported, in a cantilever-like manner, by the inner wall at one end of the external cylinder 11. The tip ends of the pair of tongue pieces 11*c* and 11*d* include the pair of the projections 11*a* and 11*b*, respectively.

In FIG. 11, the wedge-shaped ridge section 2*d* includes a slope protruding from the start point of the first straight rail groove 211 to the end point. This slope is continuous from the bottom face of the first straight rail groove 211. The tip end of the slope includes a step to be locked to the projection 11*a*. When the pair of the projections 11*a* and 11*b* are abutted with the pair of wedge-shaped ridge sections 2*d* and 2*d*, the pair of tongue pieces 11*c* and 11*d* elastically deform and deflect. When the pair of the projections 11*a* and 11*b* go over the pair of wedge-shaped ridge sections 2*d* and 2*d* and reach the end point of the first straight rail groove 211, the pair of tongue pieces 11*c* and 11*d* recover and the pair of the projections 11*a* and 11*b* are locked to the steps of the pair of wedge-shaped ridge sections 2*d* and 2*d*. Thus, the backset of the projections can be prevented.

As described above, the connector according to this another embodiment includes the wedge-shaped ridge section having a step for locking a projection that is provided at the end point of the first straight rail groove. When the plug 10 is inserted into the receptacle 20, the projection is locked to the wedge-shaped ridge section having a step, thereby providing the connection between the plug 10 and the receptacle 20. When the plug 10 is rotated to the receptacle 20 and is withdrawn in a direction along which the plug 10 is separated from the receptacle 20, the plug 10 and the receptacle 20 are disengaged from each other.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A connector in which a first connecting device and a second connecting device are attachable and detachable with respect to each other, wherein, the first connecting device comprises:

an external cylindrical cylinder, a first substantially columnar housing rotatably retained in an inner circumference of the external cylinder, and a first terminal group which is retained in the first housing and stored in an opening at one end of the external cylinder;

the second connecting device comprises:

a second housing having a substantially cylindrical connection end that can be inserted into the opening at one end of the external cylinder, and a second terminal group that is stored in the connection end and connected to the first terminal group; wherein the external cylinder includes:

one or more projections protruding from an inner wall of one end of the external cylinder, an outer circumference of the connection end, including rail grooves for guiding the projections, the rail grooves including a first straight rail groove extending in parallel with the axial direction from one end of the connection end to the other end, and a first lancet-shaped elastic piece provided at an end point of the first straight rail groove in order to lock the projection, wherein when the first connector is inserted into the second connecting device, the projection is locked to the first elastic piece to connect the first connecting device and the second connecting device and, when the first connecting device is rotated and withdrawn from the second connecting device, the first connecting device and the second connecting device are disengaged from each other.

2. A connector in which a first connecting device and a second connecting device are attachable and detachable with respect to each other, wherein, the first connecting device comprises:

an external cylindrical cylinder, a first substantially columnar housing which is rotatably retained in an inner circumference of the external cylinder, and a first terminal group which is retained in the first housing and stored in an opening at one end of the external cylinder;

the second connecting device comprises:

a second housing having a substantially cylindrical connection end that can be inserted into the opening at one end of the external cylinder, and a second terminal group that is stored in the connection end and connected to the first terminal group; wherein the external cylinder includes:

one or more projections elastically protruding from an inner wall of one end of the external cylinder, an outer circumference of the connection end, including rail grooves for guiding the projections, the rail grooves including a first straight rail groove extending in parallel with the axial direction from one end of the connection end to the other end, and a wedge-shaped ridge section having a step for locking the projection is provided at an end point of a first straight trajectory groove, wherein when the first connecting device is inserted into the second connecting device, the projection is locked to the wedge-shaped ridge section to connect the first connecting device with the second connecting device and, when the first connecting device is rotated and withdrawn from the second connecting device, the first connecting device and the second connecting device are disengaged-from each other.

3. The connector according to claim 1, wherein, the rail groove comprises:

a second straight rail groove extending in parallel with the axial direction from an opposite side of an end face of the connection end to an end face the connection end, and a helical groove providing communication between an end point of the first straight rail groove and a start point of the second straight rail groove and extending from an opposite side of an end face of the connection end to an end face of the connection end.

4. The connector according to claim 2, wherein, the rail groove comprises:

a second straight rail groove extending in parallel with the axial direction from an opposite side of an end face of the connection end to an end face the connection end, and a helical groove providing communication between an end point of the first straight rail groove and a start point of the second straight rail groove and extending from an opposite side of an end face of the connection end to an end face of the connection end.

5. The connector according to claim 3, wherein, a minute projection is provided in the vicinity of a start point of the helical groove and this minute projection restrains the projection from moving-into the helical groove when it reaches the end point of the first straight rail groove.

6. The connector according to claim 4, wherein, a minute projection is provided in the vicinity of a start point of the helical groove and this minute projection restrains the projection from moving into the helical groove when it reaches the end point of the first straight rail groove.

7. The connector according to claim 3, wherein, a second lancet-shaped elastic piece is provided in the vicinity of the end point of the helical groove and, the second elastic piece prevents the projection from returning to the helical groove when it reaches the start point of the second straight helical groove.

8. The connector according to claim 4, wherein, a second lancet-shaped elastic piece is provided in the vicinity of the end point of the helical groove and, the second elastic piece prevents the projection from returning to the helical groove when it reaches the start point of the second straight helical groove.

9. The connector according to claim 3, wherein, the first connecting device includes at least one compression coil spring in which one end is locked to the other end of the external cylinder and the other end is locked to the other end of the first housing, and the compression coil springs bias the projections engaged with the helical grooves so that the projections are rotated towards the first straight rail groove.

10. The connector according to claim 4, wherein, the first connecting device includes at least one compression coil spring in which one end is locked to the other end of the external cylinder and the other end is locked to the other end of the first housing, and the compression coil springs bias the projections engaged with the helical grooves so that the projections are rotated towards the first straight rail groove.

11. The connector according to claim 3, wherein, the first terminal group includes a plurality of first power source terminals and first signal terminals, the second terminal group includes a plurality of second power source terminals and second signal terminals, the first and second power source terminals and the first and second signal terminals are arranged so that the connections thereamong are cancelled in a sequential manner, during movement of the projection in the helical groove, the connection between the first and second signal terminals is cancelled and the connection between the first and second power source terminals is maintained, and during movement of the projection in the second straight rail groove, the connection between the first and second power source terminals is cancelled.

12. The connector according to claim 4, wherein, the first terminal group includes a plurality of first power source terminals and first signal terminals, the second terminal group includes a plurality of second power source terminals and second signal terminals, the first and second power source terminals and the first and second signal terminals are arranged so that the connections thereamong are cancelled in a sequential manner, during movement of the projection in the helical groove, the connection between the first and second signal terminals is cancelled and the connection between the first and second power source terminals is maintained, and during movement of the projection in the second straight rail groove, the connection between the first and second power source terminals is cancelled.

13. The connector according to claim 5, wherein, the first terminal group includes a plurality of first power source terminals and first signal terminals, the second terminal group includes a plurality of second power source terminals and second signal terminals, the first and second power source terminals and the first and second signal terminals are arranged so that the connections thereamong are cancelled in a sequential manner, during movement of the projection in the helical groove, the connection between the first and second signal terminals is cancelled and the connection between the first and second power source terminals is maintained, and during movement of the projection in the second straight rail groove, the connection between the first and second power source terminals is cancelled.

14. The connector according to claim 6, wherein, the first terminal group includes a plurality of first power source terminals and first signal terminals, the second terminal group includes a plurality of second power source terminals and second signal terminals, the first and second power source terminals and the first and second signal terminals are arranged so that the connections thereamong are cancelled in a sequential manner, during movement of the projection in the helical groove, the connection between the first and second signal terminals is cancelled and the connection between the first and second power source terminals is maintained, and during movement of the projection in the second straight rail groove, the connection between the first and second power source terminals is cancelled.

15. The connector according to claim 1, wherein, at least one projection consisting of two projection members, in which the two projection members are provided as a pair so as to be opposed to an inner wall at one side of the external cylinder.

16. The connector according to claim 2, wherein, at least one projection consisting of two projection members, in which the two projection members are provided as a pair so as to be opposed to an inner wall at one side of the external cylinder.

17. The connector according to claim 1, wherein, the other end of the external cylinder forms a grip section having an outer diameter larger than that of one end of the external cylinder.

18. The connector according to claim 2, wherein, the other end of the external cylinder forms a grip section having an outer diameter larger than that of one end of the external cylinder.

* * * * *